US012631080B1

(12) United States Patent
Smith et al.

(10) Patent No.: US 12,631,080 B1
(45) Date of Patent: May 19, 2026

(54) DOWNHOLE PLUG

(71) Applicant: Halliburton Energy Services, Inc., Houston, TX (US)

(72) Inventors: Donald Smith, Wilson, OK (US); Matthew Dexter, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/086,826

(22) Filed: Mar. 21, 2025

(51) Int. Cl.

| | |
|---|---|
| ***E21B 23/06*** | (2006.01) |
| ***E21B 33/12*** | (2006.01) |
| ***E21B 33/124*** | (2006.01) |
| ***E21B 33/129*** | (2006.01) |
| ***E21B 33/134*** | (2006.01) |

(52) U.S. Cl.
CPC ..... *E21B 23/06* (2013.01); *E21B 33/12* (2013.01); *E21B 33/124* (2013.01); *E21B 33/129* (2013.01); *E21B 33/134* (2013.01)

(58) Field of Classification Search
CPC ..... E21B 23/06; E21B 33/12; E21B 33/124; E21B 33/129
See application file for complete search history.

(56) References Cited

U.S. PATENT DOCUMENTS

| | | | | |
|---|---|---|---|---|
| 6,220,349 | B1 | 4/2001 | Vargus et al. | |
| 2013/0186616 | A1* | 7/2013 | Xu | E21B 33/129 166/212 |
| 2013/0206409 | A1* | 8/2013 | Stone | E21B 43/261 166/135 |
| 2013/0319669 | A1* | 12/2013 | DuPree | E21B 34/142 166/194 |
| 2016/0138363 | A1 | 5/2016 | Sommers | |
| 2017/0268310 | A1 | 9/2017 | Shkurti et al. | |
| 2017/0362912 | A1* | 12/2017 | Smith | E21B 33/1291 |
| 2018/0023359 | A1* | 1/2018 | Xu | E21B 33/12 166/376 |
| 2018/0171744 | A1 | 6/2018 | Markel et al. | |
| 2018/0328136 | A1* | 11/2018 | Smith | E21B 33/129 |
| 2020/0240233 | A1* | 7/2020 | Chenault | E21B 23/06 |
| 2020/0370392 | A1* | 11/2020 | Jordan, Jr. | E21B 33/1216 |
| 2021/0140264 | A1* | 5/2021 | Sommers | E21B 33/134 |
| 2021/0277741 | A1* | 9/2021 | Xue | E21B 33/134 |
| 2021/0404285 | A1* | 12/2021 | Reyes Villegas | E21B 33/1292 |
| 2022/0049573 | A1* | 2/2022 | Jacob | E21B 33/124 |
| 2024/0287867 | A1 | 8/2024 | Patsy et al. | |
| 2024/0287869 | A1* | 8/2024 | Yuan | E21B 33/128 |

OTHER PUBLICATIONS

"PCT Application No. PCT/US2025/023082 International Search Report and Written Opinion", Dec. 10, 2025, 10 pages.

* cited by examiner

*Primary Examiner* — Neel Girish Patel
(74) *Attorney, Agent, or Firm* — DeLizio, Peacock, Lewin & Guerra LLP

(57) ABSTRACT

In some implementations, an apparatus may comprise a collet sleeve configured for insertion into a cavity of a mule shoe and including teeth configured to ratchet with pawls of the mule shoe. The apparatus also may comprise a packing element surrounding a portion of the collet sleeve and configured to radially expand to form a seal with a casing of a wellbore in response to a setting force to join the teeth and the pawls.

15 Claims, 9 Drawing Sheets

DOWNHOLE PLUG

TECHNICAL FIELD

Some implementations relate to oil and gas production. More specifically, some implementations relate to a downhole plug assembly used in connection with oil and gas production.

BACKGROUND

A frac plug is a tool used in oil and gas production, such as during operations for hydraulic fracturing ("fracking"). The frac plug may temporarily isolate different sections of a wellbore to allow for targeted fracturing of specific intervals. Frac plugs may assist in efficiently creating fractures in rock formations and enhance the flow of hydrocarbons.

BRIEF DESCRIPTION OF THE DRAWINGS

Implementations of the disclosure may be better understood by referencing the accompanying drawings.

DESCRIPTION OF IMPLEMENTATIONS

The description that follows may include example systems, methods, techniques, and program flows that embody implementations of the disclosure. However, this disclosure may be practiced without these specific details. For clarity, some well-known instruction instances, protocols, structures, and techniques may not be shown in detail.

Overview

A frac plug assembly may include a frac plug ("plug") configured to mate with a mule shoe and be inserted into a wellbore via a set tool. The plug may include an elastic packing element that expands into contact with the casing and seals off a segment of the wellbore. Additionally, the plug may include a collet sleeve that ratchets into the mule shoe and holds the frac plug in a set position in which the packing element creates a seal with the casing. As the plug ratchets into the mule shoe, the plug may squeeze the packing element causing the packing element to radially expand into the set position (seal made with casing). After the plug ratchets into the set position, the set load remains in the packing element. Hence, the plug may be set (seal made) before hydraulic pressure is applied in the wellbore. After the hydraulic pressure is applied, the hydraulic pressure may further compress the packing element to create a tighter seal while the collet sleeve remains securely coupled with the mule shoe. If the hydraulic pressure in the wellbore is reduced, the plug assembly may relax to the set position (such as the compressed position resulting from ratcheting the collet sleeve into the mule shoe).

Traditional plugs may lose seal with the casing after hydraulic pressure in the wellbore is reduced. However, some implementations of the plug utilize the ratcheting collet sleeve to maintain seal through numerous hydraulic pressure cycles. Moreover, some implementations of the plug (and plug assembly) have fewer components than traditional plugs. Hence, some implementations have lower production costs and more reliable performance.

Example Implementations

Figure 1:
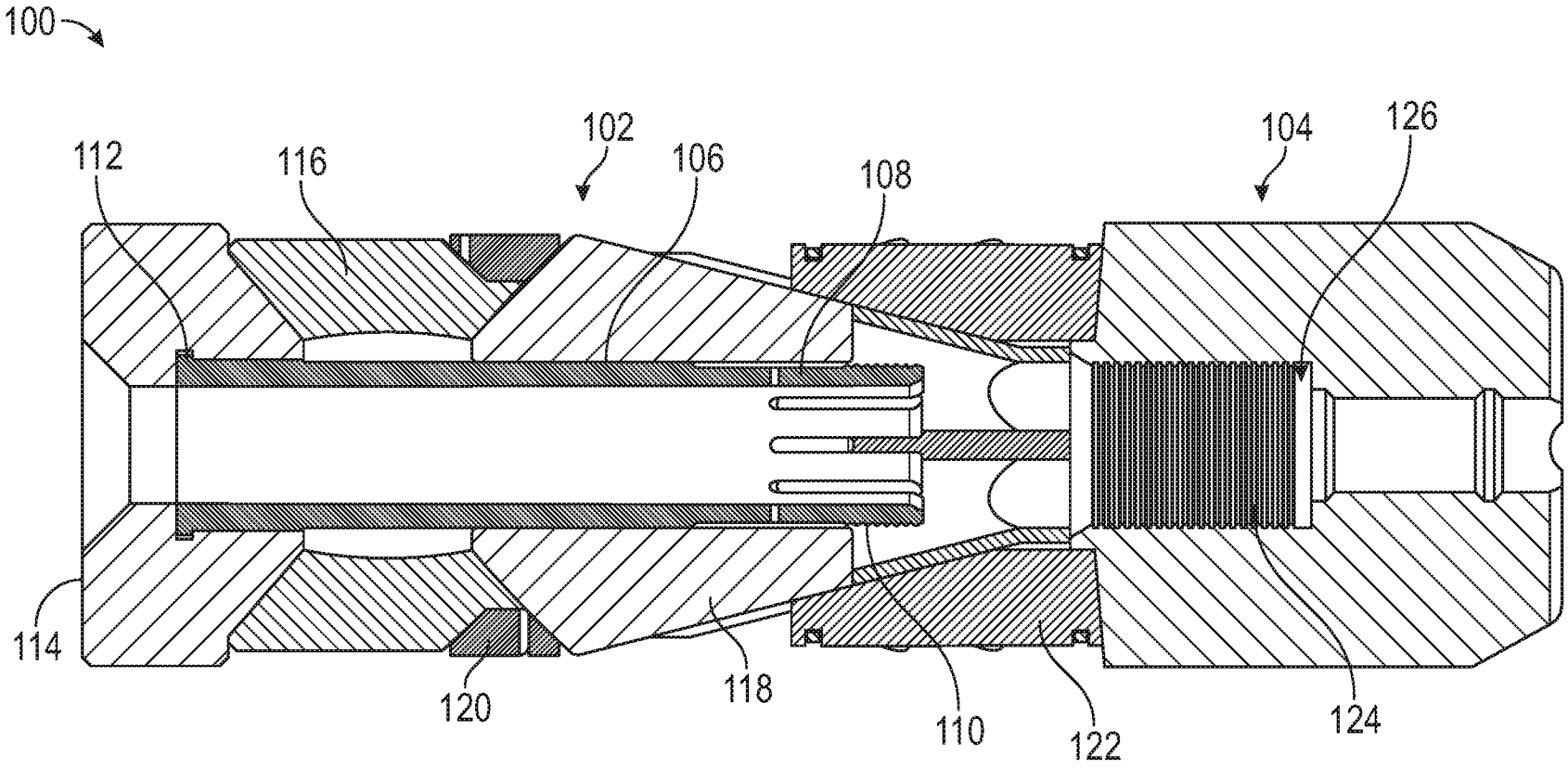
FIG. 1 is a sectional view illustrating a plug assembly.

FIG. 1 is a sectional view illustrating a plug assembly 100. FIG. 1 shows the plug 102 before it couples with the mule shoe 104. The mule shoe 104 may include a cavity 126 defined by an inner surface of the mule shoe 104. The inner surface of the mule shoe 104 may include pawls 124.

The plug 102 may include a cylindrical collet sleeve 106 that includes collet fingers 108. The collet fingers 108 each may include teeth 110 configured to ratchet with the pawls 124 of the mule shoe 104. The collet sleeve 106 may be surrounded by a wedge 118, packing element 116, and element support ring 114. That is, the collet sleeve 106 may pass through the wedge 118, packing element 116, and a portion of the element support ring 114. The collet sleeve 106 may include a flanged end 112 configured for coupling with the element support ring 114. Alternatively, the collet sleeve 106 and element support ring 114 may be integrated to form a unitary component (see also discussion of FIG. 5). When the plug 102 couples with the mule shoe 104, the collet fingers 108 and teeth 110 may ratchet into the mule shoe's pawls 124. Such ratcheting may cause the element support ring 114 and wedge 118 to squeeze the packing element 116, causing the packing on 116 to expand radially outward (see also discussion of FIG. 3).

The plug assembly 100 may include slips 122 configured to move radially outward and contact the casing of the wellbore. The slips 122 may move radially outward when the plug 102 ratchets into the mule shoe 104 (see also discussion of FIG. 3). As the slips 122 move radially outward, they may anchor the plug assembly 100 to the casing of the wellbore.

The plug 102 may include an extrusion limiter 120 configured to transfer setting forces from the slips 122 to the packing element 116. Setting forces may arise when the collet sleeve 106 ratchets into the pawls 124 of the mule shoe 104 (see also discussion of FIG. 3). By ratcheting the teeth 110 into the pawls 124, the setting force is trapped within the teeth 110 and the pawls 124, thus maintaining the packing element 116 in the set position (avoiding relaxation of the packing element 116 out of the set position).

Figure 2:
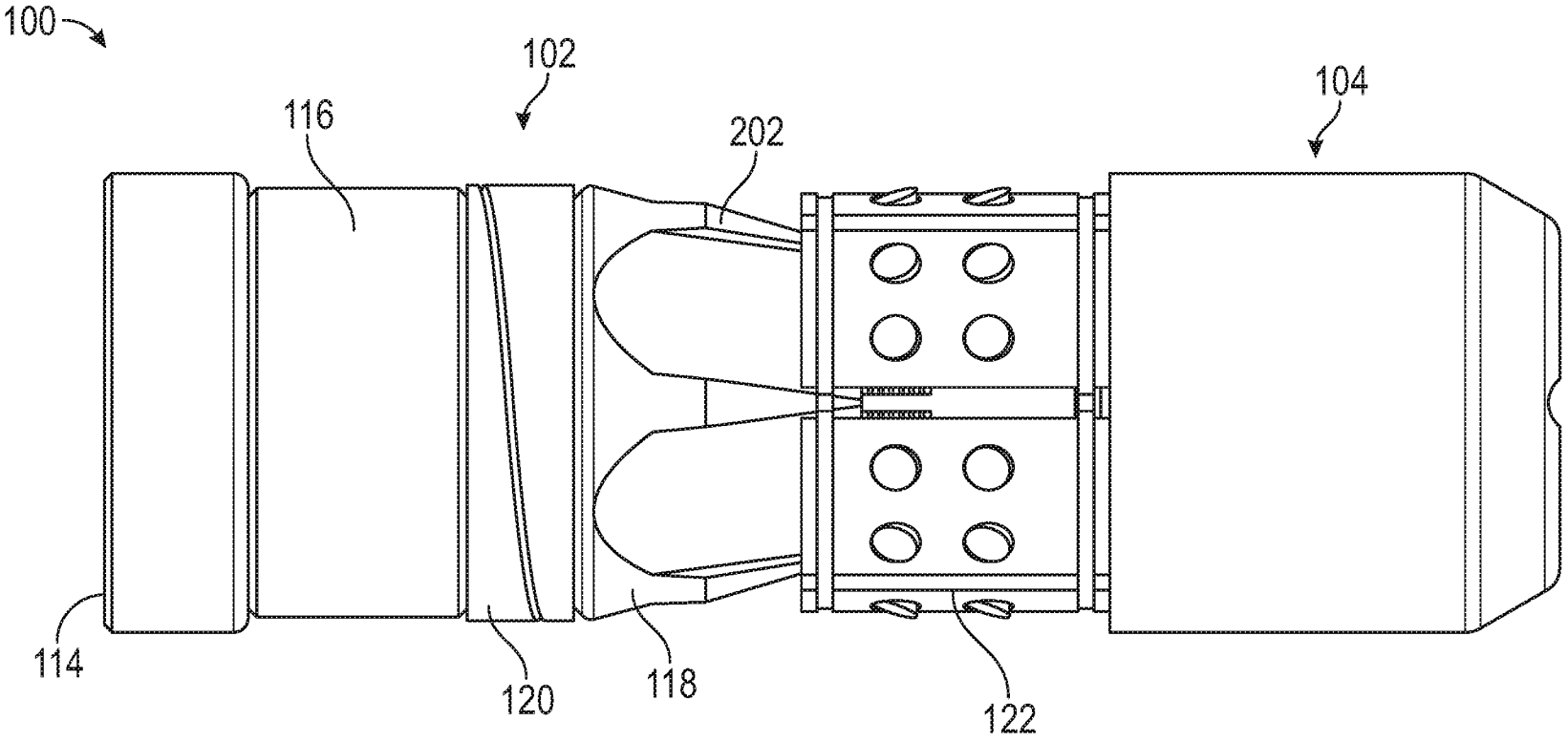
FIG. 2 is a perspective view of the plug assembly.

FIG. 2 is a perspective view of the plug assembly 100. FIG. 2 shows the plug 102 before it couples with the mule shoe 104. As shown, the plug 102 may include the element support ring 114, packing element 116, extrusion limiter 120, and wedge 118. The wedge may include ridges 202. The slips 122 may move axially between the ridges 202. The mule shoe 104 may be coupled with the slips 122.

Figure 3:
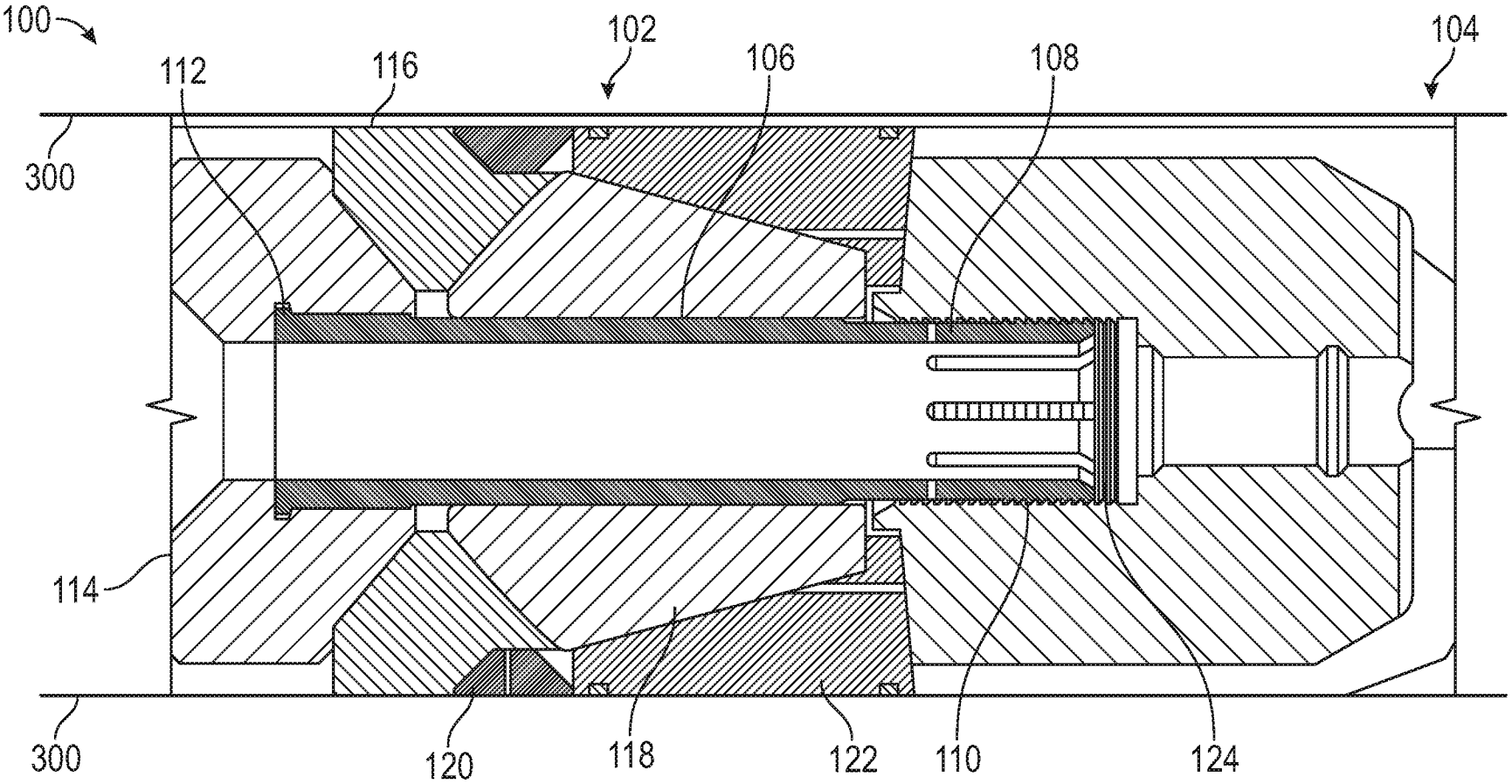
FIG. 3 is a sectional view of the plug assembly.

FIG. 3 is a sectional view of the plug assembly 100. FIG. 3 shows the plug 102 coupled with the mule shoe 104 inside a casing 300. As shown, the collet fingers 108 have ratcheted into the pawls 124 of the mule shoe 104. As the collet sleeve 106 ratchets into the mule shoe 104, the collet sleeve 106 may draw the element support ring 114 into the packing element 116, causing radial expansion of the packing element 116. Upon radial expansion, the packing element 116 may create a seal with the casing 300. Additionally, as the collet sleeve 106 ratchets into the mule shoe 104, the wedge 118 may push the slips 122 radially outward into contact with the casing 300. As the slips 122 contact the casing 300, the slips may anchor the plug assembly 100 to the casing 300. Hence, the plug may be set (seal made) before hydraulic pressure is applied in the wellbore during hydraulic fracturing operations. After the hydraulic pressure is applied, the hydraulic pressure may further compress the packing element 116 to create a tighter seal while the collet sleeve 106 remains securely coupled with the mule shoe. If the hydraulic pressure in the wellbore is reduced, the plug assembly 100 may relax to the set position (such as the compressed position resulting from ratcheting the collet sleeve 106 into the mule shoe 104).

As shown, the slips 122 may push the extrusion limiter 120 into the packing element 116. Hence, the extrusion limiter 120 may contribute to the expansion and/or deformation of the packing element 116. Some implementations of the plug assembly 100 may exclude the extrusion limiter 120 altogether.

Figure 4:
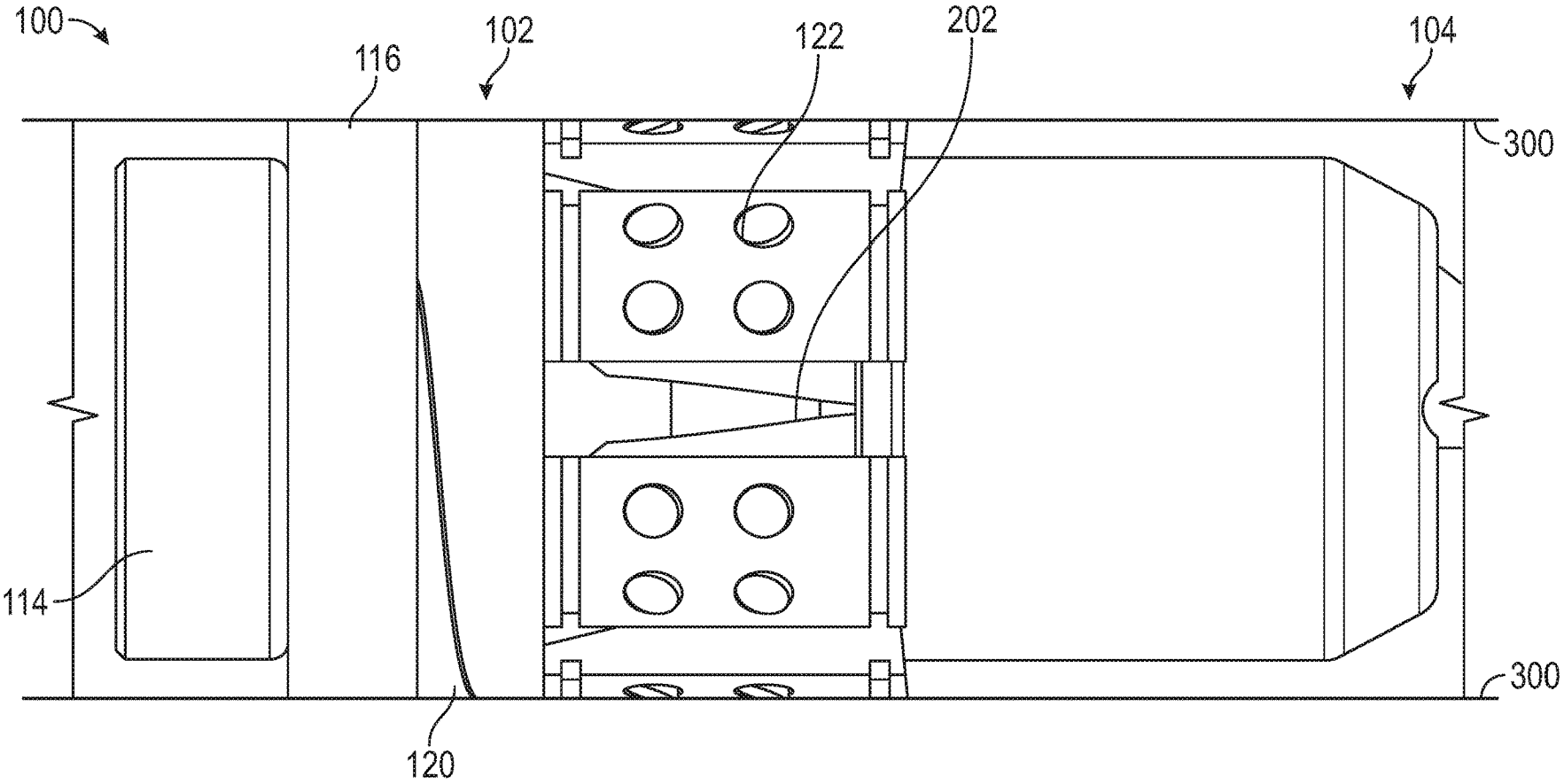
FIG. 4 is a perspective view of the plug assembly.

FIG. 4 is a perspective view of the plug assembly 100. FIG. 4 shows the plug 102 coupled with the mule shoe 104 inside the casing 300. As shown, the plug assembly 100 may include the plug 102, slips 122, and the mule shoe 104. The plug 102 may include an element support ring 114, packing element 116, and extrusion limiter 120.

Figure 5:
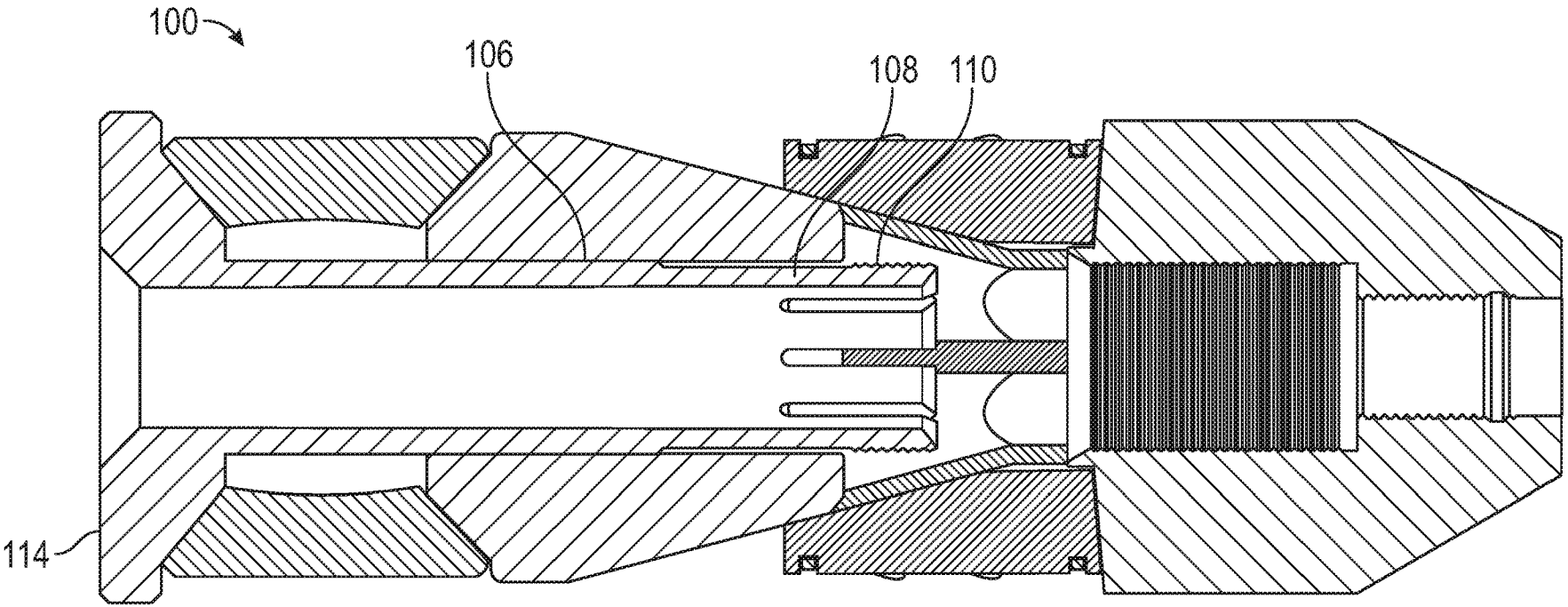
FIG. 5 is a sectional view illustrating the plug assembly

FIG. 5 is a sectional view illustrating the plug assembly. In FIG. 5, the collet sleeve 106 and element support ring 114 are included in a single unitary component. The implementation shown in FIG. 5 may operate similar to other implementations described herein.

Figure 6:
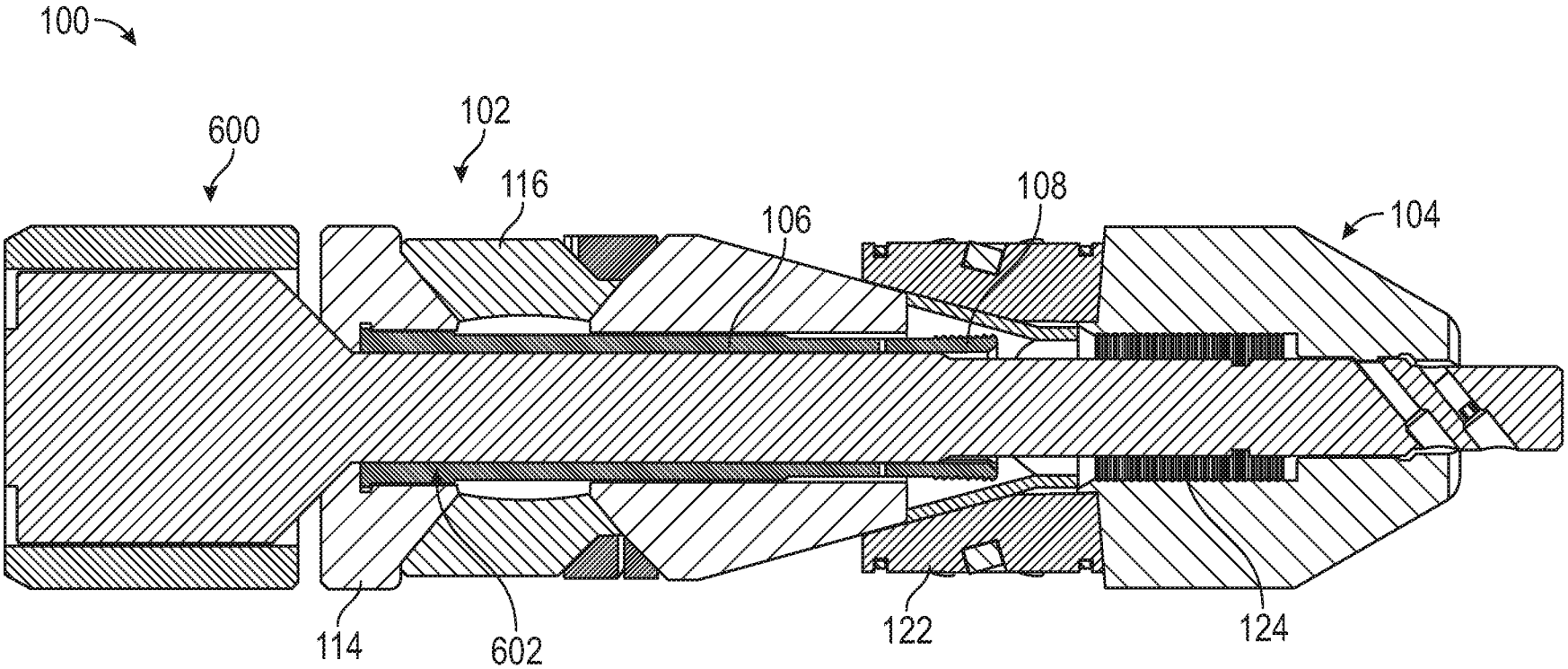
FIG. 6 is a sectional view illustrating the plug assembly coupled with a wireline adapter kit.

FIG. 6 is a sectional view illustrating the plug assembly 100 coupled with a wireline adapter kit 600. As shown, the wireline adapter kit 600 may be coupled with the plug assembly 100. For example, the set tool may be inserted into a cylindrical cavity 602 formed by the element support ring 114, collet sleeve 106, and mule shoe 104. The wireline adapter kit 600 and plug assembly 100 may be inserted into a wellbore and moved to a specified position in the wellbore. The wireline adapter kit 600 may apply a force to the element support ring 114 and/or the mule shoe 104 to move the collet sleeve 106 into the mule shoe 104. In response to the force, the collet fingers 108 may ratchet into the pawls 124, locking the plug 102 into the mule shoe 104 and expanding the packing element 116 and slips 122. The wireline adapter kit 600 may decouple from the plug assembly 100.

Example Operations and Methods

Figure 7:
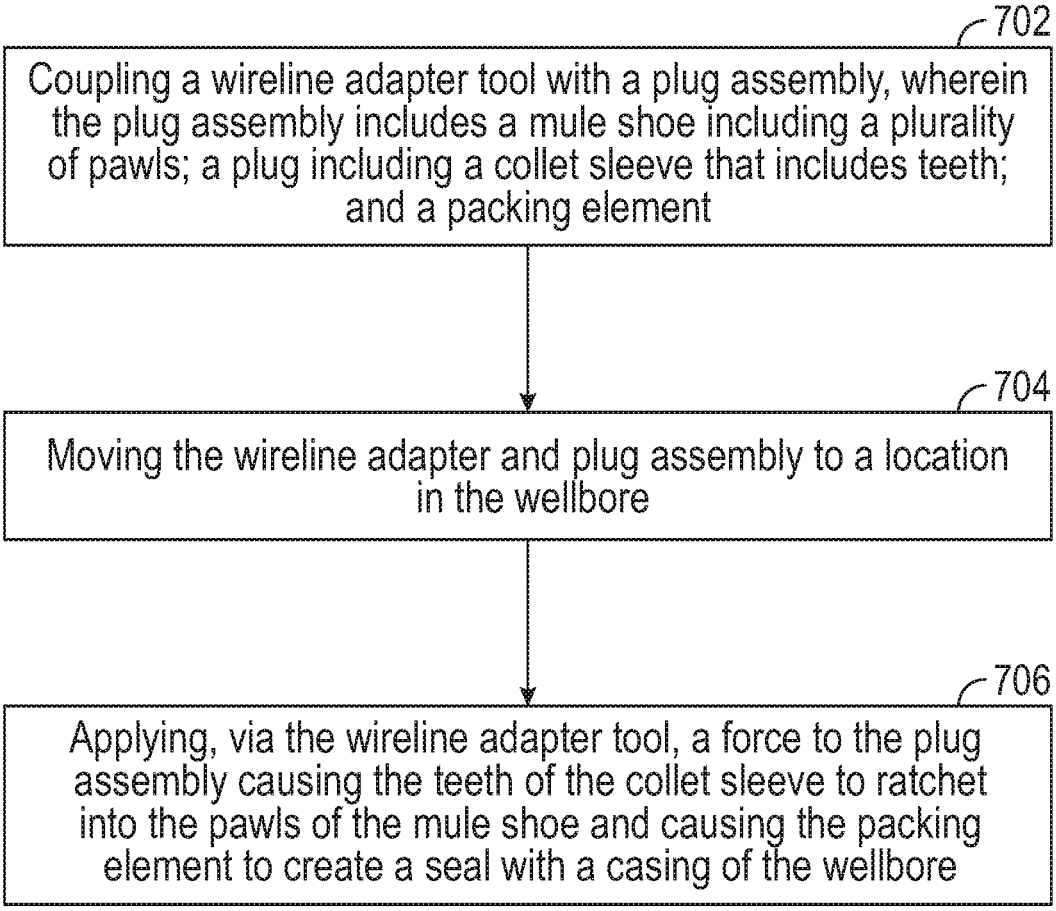
FIG. 7 is a block diagram illustrating operations for sealing a wellbore.

FIG. 7 is a block diagram illustrating operations for sealing a wellbore. Operations begin at block 702.

At block 702, the wireline adapter kit 600 is coupled with a plug assembly 100, wherein the plug assembly 100 includes a mule shoe 104 including a plurality of pawls 124; a plug 102 including a collet sleeve 106 that includes teeth 110; and a packing element 116.

At block 704, the wireline adapter kit 600 and plug assembly 100 are moved to a location in the wellbore.

At block 706, the wireline adapter kit 600 applies a setting force to the plug assembly 100 causing the teeth 110 of the collet sleeve 106 to ratchet into the pawls 124 of the mule shoe 104 and causing the packing element 116 to create a seal with a casing 300 of the wellbore.

Example Environment

Figure 8:
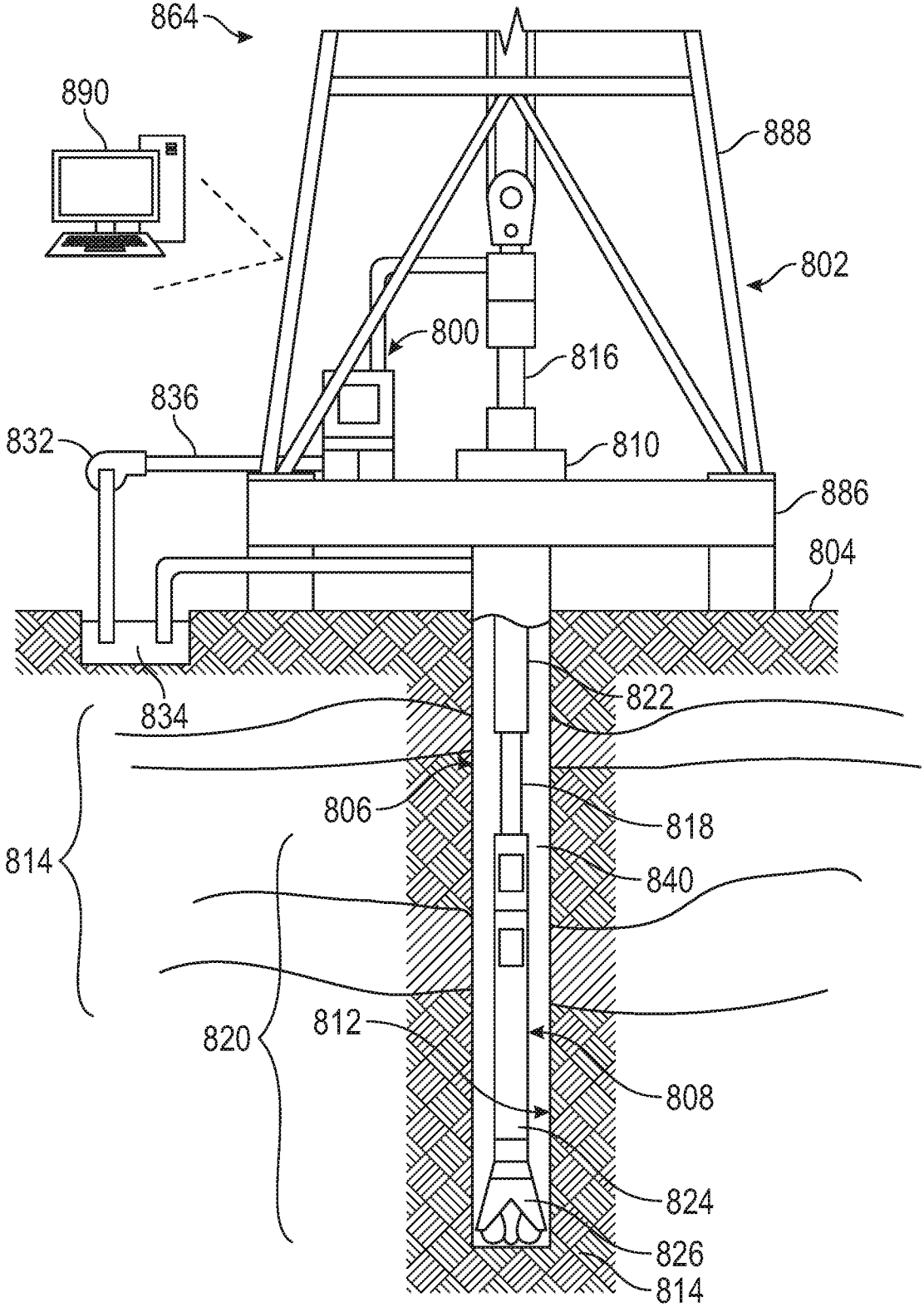
FIG. 8 is a schematic diagram of a drilling system.

FIG. 8 is a schematic diagram of a drilling system 864. The drilling system 864 may include at least a portion of a drilling rig 802 located at the surface 804 of a well 806. Drilling of oil and gas wells is commonly conducted using a string of drill pipes connected to form a drilling string 808 that may be lowered through a rotary table 810 into a wellbore or borehole 812. Here a drilling platform 886 may be equipped with a derrick 888 that supports a hoist. A computer system 890 may be used to control one or more operations of the drilling system 864.

The drilling rig 802 may thus provide support for the drill string 808. The drill string 808 may operate to penetrate the rotary table 810 for drilling the borehole 812 through subsurface formations 814. The drill string 808 may include a Kelly 816, drill pipe 818, and a bottom hole assembly 820, perhaps located at the lower portion of the drill pipe 818.

The bottom hole assembly 820 may include drill collars 822, a down hole tool 824, and a drill bit 826. The drill bit 826 may operate to create a borehole 812 by penetrating the surface 804 and subsurface formations 814. The down hole tool 824 may comprise any of a number of different tool types including MWD tools, LWD tools, and others.

During drilling operations, the drill string 808 (such as including the Kelly 816, the drill pipe 818, and the bottom hole assembly 820) may be rotated by the rotary table 810. In addition to, or alternatively, the bottom hole assembly 820 may also be rotated by a motor (e.g., a mud motor) that may be located down hole. The drill collars 822 may be used to add weight to the drill bit 826. The drill collars 822 may also operate to stiffen the bottom hole assembly 820, allowing the bottom hole assembly 820 to transfer the added weight to the drill bit 826, and in turn, to assist the drill bit 826 in penetrating the surface 804 and subsurface formations 814.

During drilling operations, a mud pump 832 may pump drilling fluid (sometimes known by those of ordinary skill in the art as "drilling mud") from a mud pit 834 through a hose 836 into the drill pipe 818 and down to the drill bit 826. The drilling fluid may flow out from the drill bit 826 and be returned to the surface 804 through an annular area 840 between the drill pipe 818 and the sides of the borehole 812. The drilling fluid may then be returned to the mud pit 834, where such fluid may be filtered. In some embodiments, the drilling fluid may be used to cool the drill bit 826, as well as to provide lubrication for the drill bit 826 during drilling operations. Additionally, the drilling fluid may be used to remove subsurface formation 814 cuttings created by operating the drill bit 826. It may be the images of these cuttings that many implementations operate to acquire and process.

The drilling system 864 may drill horizontal wellbores for use with hydraulic fracturing and other operations. During such operations, the plug assembly 100 may be deployed to isolate a segment of the wellbore 812. Any of the components described herein and other components may be used to facilitate operations involving the plug assembly 100 and a set tool (such as to insert, remove, activate, and/or deactivate the plug assembly 100 in the wellbore) (see also tool 902 of FIG. 9).

Figure 9:
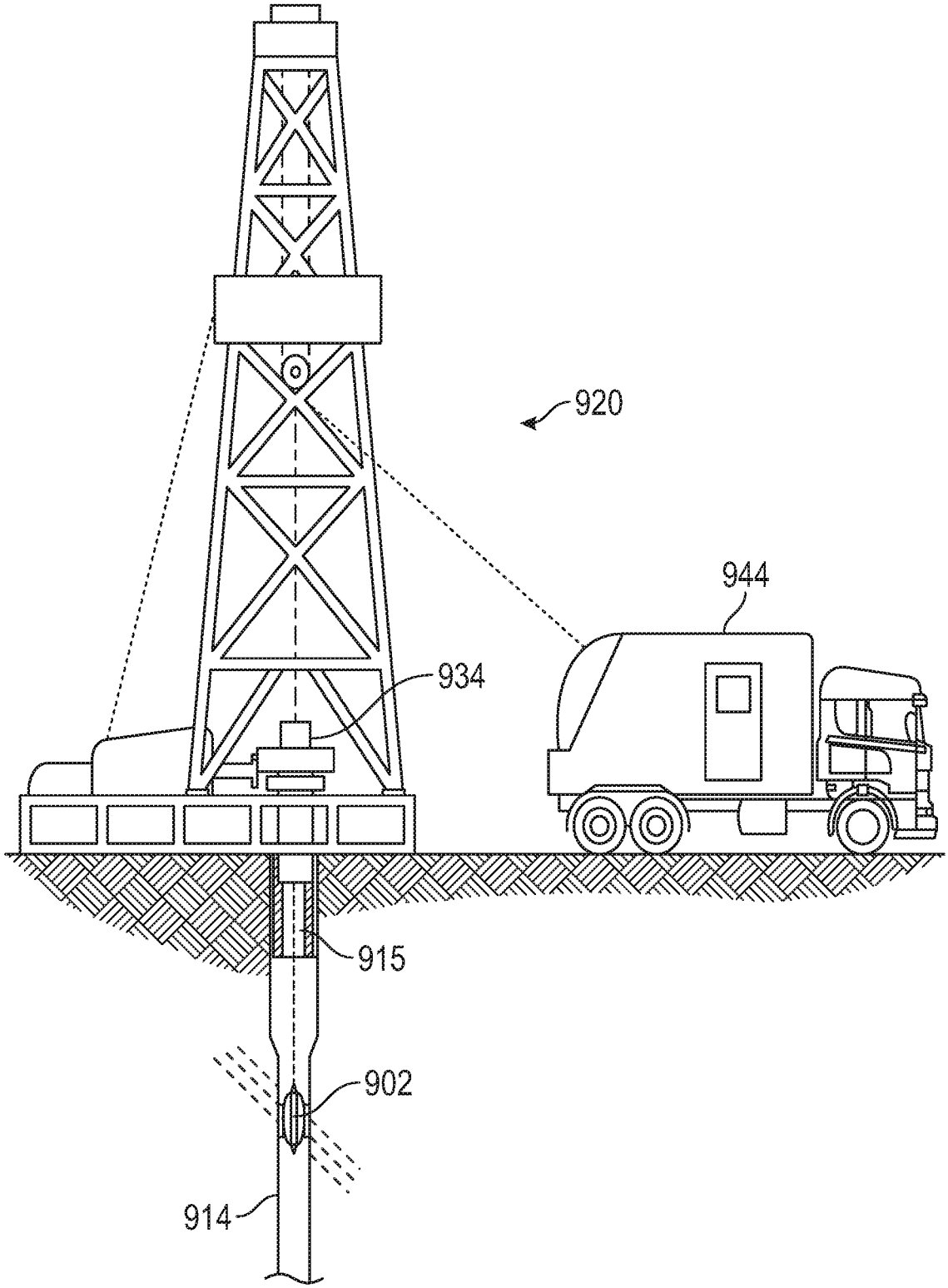
FIG. 9 depicts a schematic diagram of a wireline.

FIG. 9 depicts a schematic diagram of a wireline. A wireline system 920 may be used in an illustrative logging environment with a drillstring removed, in accordance with some embodiments of the present disclosure.

Subterranean operations may be conducted using a wireline system 920 once the drillstring has been removed. However, some or all of the drillstring may remain in a borehole 914 during logging with the wireline system 920. The wireline system 920 may include one or more tools 902 that may be suspended in the borehole 914 by a conveyance 915 (e.g., a cable, slickline, or coiled tubing). The tool 902 may be used to insert, remove, activate, and/or deactivate the plug assembly 100 in the wellbore. The tool 902 may include electrical components and may be communicatively coupled to the conveyance 915. The conveyance 915 may contain conductors for transporting power to the wireline system 920 and telemetry from the tool 902 to a logging facility 944. Alternatively, the conveyance 915 may lack a conductor, as is often the case using slickline or coiled tubing, and the wireline system 920 may contain a control unit that contains memory, one or more batteries, and/or one or more processors for performing operations and storing measurements.

The wireline system 920 may include a logging facility 944. The logging facility 944 (shown in FIG. 9 as a truck, although it may be any other structure) may collect measurements from the tool 902, and may include computing facilities for controlling, processing, or storing the measurements gathered by the tool 902. The computing facilities may be communicatively coupled to the tool 902 by way of the conveyance 915. The wireline system 920 may include other components for facilitating or cooperating with various implementations.

FIGS. 1-9 and the operations described herein are examples meant to aid in understanding example implementations and should not be used to limit the potential implementations or limit the scope of the claims. Some implementations may perform additional operations, fewer operations, operations in parallel or in a different order, and some operations differently. Some implementations may perform the operations with different components.

As used herein, a phrase referring to "at least one of" a list of items refers to any combination of those items, including single members. As an example, "at least one of: a, b, or c" is intended to cover: a, b, c, a-b, a-c, b-c, and a-b-c.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein but are to be accorded the widest scope consistent with this disclosure, the principles and the novel features disclosed herein.

Certain features that are described in this specification in the context of separate implementations also may be implemented in combination in a single implementation. Conversely, various features that are described in the context of a single implementation also may be implemented in multiple implementations separately or in any suitable subcombination. Moreover, although features may be described as acting in certain combinations and even initially claimed as such, one or more features from a claimed combination may in some cases be removed from the combination, and the claimed combination may be directed to a subcombination or variation of a subcombination.

Example Clauses

Clause 1: An apparatus comprising: a collet sleeve configured for insertion into a cavity of a mule shoe and including teeth configured to ratchet with pawls of the mule shoe; and a packing element surrounding a portion of the collet sleeve and configured to radially expand to form a seal with casing of a wellbore in response to a setting force to join the teeth and the pawls.

Clause 2: The apparatus of clause 1 further including: an element support ring coupled with the collet sleeve and configured to transfer the setting force into the packing element to cause the radial expansion of the packing element.

Clause 3: The apparatus of any one or more of clauses 1-2, wherein the collet sleeve includes collet fingers on a first end, wherein the teeth reside on the collet fingers.

Clause 4: The apparatus of any one or more of clauses 1-3, wherein the collet sleeve includes a flange on a second end, the flange configured to connect the collet sleeve to the element support ring.

Clause 5: The apparatus of any one or more of clauses 1-4, wherein the apparatus further includes a wedge surrounding a portion of the collet sleeve and in contact with the packing element and the mule shoe; and a plurality slips configured to radially expand about the wedge in response to the setting force.

Clause 6: The apparatus of any one or more of clauses 1-5, the plug further including: an extrusion limiter coupled with the wedge and the packing element and configured to move radially outward with the radial expansion of the packing element.

Clause 7: The apparatus of any one or more of clauses 1-6, wherein the element support ring, collet sleeve, and packing element all include a void configured to mate with a wireline adapter kit.

Clause 8: The apparatus of any one or more of clauses 1-7 further including: a mule shoe including the cavity formed by an inner surface of the mule shoe; and the pawls residing on the inner surface of the mule shoe.

Clause 9: A system comprising: a mule shoe including a cavity formed by an inner surface of the mule shoe; a plurality of pawls residing on the inner surface of the mule shoe; a plug configured to couple with the mule shoe, the plug including a collet sleeve configured for insertion into the cavity and including teeth configured to ratchet with the pawls of the mule shoe; and a packing element surrounding a portion of the collet sleeve and configured to radially expand to form a seal with a casing of a wellbore in response to a setting force to ratchet the teeth with the pawls.

Clause 10: The system of clause 9, the plug further including: an element support ring coupled with the collet sleeve and configured to transfer the setting force into the packing element to cause the radial expansion of the packing element.

Clause 11: The system of any one or more of clauses 9-10, wherein the plug further includes a wedge surrounding a portion of the collet sleeve and in contact with the packing element and the mule shoe; and a plurality slips configured to radially expand about the wedge in response to the setting force.

Clause 12: The system of any one or more of clauses 9-11, the plug further including: an extrusion limiter coupled with the wedge and packing element and configured to move radially outward with the radial expansion of the packing element.

Clause 13: The system of any one or more of clauses 9-12, wherein the element support ring, collet sleeve, and packing element all include a void configured to mate with a wireline adapter kit.

Clause 14: The system of any one or more of clauses 9-13, wherein the collet sleeve includes a flange on a second end, the flange configured to connect the collet sleeve to the element support ring.

Clause 15: The system of any one or more of clauses 9-14, wherein the collet sleeve includes collet fingers on a first end, wherein the teeth reside on the collet fingers.

Clause 16: A method comprising: coupling an wireline adapter kit with a plug assembly, wherein the plug assembly includes a mule shoe including a plurality of pawls; a plug including a collet sleeve that includes teeth; and a packing element; moving the wireline adapter kit and plug assembly to a location in a wellbore; applying, via the wireline adapter kit, a force to the plug assembly causing the teeth of the collet sleeve to ratchet into the pawls of the mule shoe and causing the packing element to create a seal with a casing of the wellbore.

Clause 17: The method of clause 16 further comprising: uncoupling the wireline adapter kit from the plug assembly; and applying a first hydraulic pressure in the wellbore, wherein the first hydraulic pressure is contained by the seal with the casing of the wellbore.

Clause 18: The method of any one or more of clauses 16-17 further comprising: eliminating the first hydraulic pressure; applying a second hydraulic pressure to the wellbore, wherein the seal with the casing of the wellbore is maintained during the second hydraulic pressure.

Clause 19: The method of any one or more of clauses 16-18 further comprising: applying a second hydraulic pressure, wherein the seal with the casing of the wellbore is maintained during the second hydraulic pressure.

Clause 20: The method of any one or more of clauses 16-18 further comprising: drilling the plug assembly to remove it from the wellbore.

The invention claimed is:

1. An apparatus comprising:

a collet sleeve configured for insertion into a cavity of a mule shoe, wherein the collet sleeve includes a plurality of collet fingers extending from a first end of the collet sleeve, each collet finger including teeth configured to ratchet with pawls of the mule shoe;

a packing element surrounding a portion of the collet sleeve separate from the collet fingers, the packing element configured to radially expand to form a seal with a casing of a wellbore in response to a setting force; and an element support ring coupled with the collet sleeve and configured to transfer the setting force into the packing element, wherein the collet sleeve further includes a flange on a second end, the flange configured to connect the collet sleeve to the element support ring, wherein the flange is positioned and supported directly radially within the element support ring, and wherein the setting force causes the collet fingers to bend sufficient to ratchet the teeth into the pawls of the mule shoe, locking the collet sleeve into the mule shoe.

2. The apparatus of claim 1, wherein the apparatus further includes a wedge surrounding a portion of the collet sleeve and in contact with the packing element; and a plurality of slips connected to the wedge, the slips configured to radially expand about the wedge in response to the setting force.

3. The apparatus of claim 2 further including:

an extrusion limiter coupled with the packing element and configured to move radially outward away from the wedge in response to the setting force applied to the packing element.

4. The apparatus of claim 1, wherein the element support ring, collet sleeve, and packing element all include a void configured to mate with a wireline adapter kit.

5. The apparatus of claim 1, wherein the mule shoe includes a cavity formed by an inner surface of the mule shoe, the pawls residing on at least a portion of the inner surface of the mule shoe.

6. A system comprising:

a mule shoe including-a cavity formed by an inner surface of the mule shoe; and a plurality of pawls residing on at least a portion of the inner surface of the mule shoe;

a plug configured to couple with the mule shoe, the plug including:

a collet sleeve configured for insertion into the cavity, wherein the collet sleeve includes a plurality of collet fingers extending from a first end of the collet sleeve, each collet finger including teeth configured to ratchet with the pawls of the mule shoe;

a packing element surrounding a portion of the collet sleeve separate from the collet fingers, the packing element configured to radially expand to form a seal with a casing of a wellbore in response to a setting force;

an element support ring coupled with the collet sleeve and configured to transfer the setting force into the packing element, wherein the collet sleeve further includes a flange on a second end, the flange configured to connect the collet sleeve to the element support ring, wherein the flange is positioned and supported directly radially within the element support ring, and wherein the setting force causes the collet fingers to bend sufficient to ratchet the teeth into the pawls of the mule shoe, locking the collet sleeve into the mule shoe.

7. The system of claim 6, wherein the plug further includes a wedge surrounding a portion of the collet sleeve and in contact with the packing element; and one or more slips connected to the wedge, the slips configured to radially expand about the wedge in response to the setting force.

8. The system of claim 7, the plug further including:

an extrusion limiter coupled with packing element and configured to move radially outward away from the wedge in response to the setting force applied to the packing element.

9. The system of claim 8, wherein the element support ring, collet sleeve, and packing element all include a void configured to mate with a wireline adapter kit.

10. A method comprising:

coupling a wireline adapter kit with a plug assembly, wherein the plug assembly includes:

a mule shoe including a plurality of pawls; and a plug, the plug including:

a collet sleeve that includes a plurality of collet fingers extending from a first end of the collet sleeve, each collet finger including a plurality of teeth;

a packing element surrounding a portion of the collet sleeve separate from the plurality of collet fingers; and an element support ring coupled with the collet sleeve and configured to transfer the setting force into the packing element, wherein the collet sleeve further includes a flange on a second end, the flange configured to connect the collet sleeve to the element support ring, wherein the flange is positioned and supported directly radially within the element support ring, moving the wireline adapter kit and the plug assembly to a location in a wellbore; and applying, via the wireline adapter kit, a setting force to the plug assembly, the setting force causing the teeth of the collet sleeve to ratchet into the pawls of the mule shoe, locking the collet sleeve into the mule shoe, and further causing the packing element to radially expand to create a seal with a casing of the wellbore.

11. The method of claim 10 further comprising:

uncoupling the wireline adapter kit from the plug assembly; and applying a first hydraulic pressure in the wellbore, wherein the first hydraulic pressure is contained by the seal with the casing of the wellbore.

12. The method of claim 11 further comprising:

eliminating the first hydraulic pressure;

applying a second hydraulic pressure to the wellbore, wherein the seal with the casing of the wellbore is maintained during the second hydraulic pressure.

13. The method of claim 11 further comprising:

applying a second hydraulic pressure, wherein the seal with the casing of the wellbore is maintained during the second hydraulic pressure.

14. The method of claim 10, wherein transferring the setting force from the element support ring to the collet sleeve includes deforming the collet fingers under the setting force transferred to the collet sleeve such that the collet fingers slip inside the mule shoe to ratchet into the pawls.

15. The method of claim 14, wherein the plug assembly further includes:

a wedge surrounding a portion of the collet sleeve and in contact with the packing element;

an extrusion limiter coupled with the packing element, and one or more slips adjacent to the wedge, wherein transferring the setting force from the element support ring to the packing element includes:

radially expanding the packing element to make a seal with the casing of the wellbore;

shifting the extrusion limiter radially outward away from the wedge in response to the radial expansion of the packing element; and shifting the wedge parallel to the collet sleeve, pushing the slips outward in a radial direction until the slips contact the casing of the wellbore.

* * * * *